US005318420A

United States Patent [19]

Blaimschein

[11] Patent Number: 5,318,420

[45] Date of Patent: Jun. 7, 1994

[54] APPARATUS FOR ULTRASONICALLY CUTTING WORKPIECES MADE OF POLYMERS

[75] Inventor: Gottfried Blaimschein, Steyr, Austria

[73] Assignee: GFM Gesellschaft für Fertigungstechnik und Maschinenbau Aktiengesellschaft, Steyr, Austria

[21] Appl. No.: 967,108

[22] Filed: Oct. 27, 1992

[30] Foreign Application Priority Data

Oct. 30, 1991 [AT] Austria ..... 2154/91

[51] Int. Cl.[5] ..... B26D 1/06; B26D 7/08

[52] U.S. Cl. ..... 425/174.2; 83/170; 83/701; 264/23; 264/138; 425/289; 425/301

[58] Field of Search ..... 425/174.2, 174, 289, 425/301, 310, 311, 806; 264/68, 80, 23, 25, 138, 140, 145, 157, 161; 156/73.2, 73.3, 580.1, 580.2; 83/701, 170, 169

[56] References Cited

U.S. PATENT DOCUMENTS

| | | | |
|---|---|---|---|
| 3,866,642 | 2/1975 | Walser | 83/169 |
| 4,132,519 | 1/1979 | Reed | 83/701 |
| 4,227,959 | 10/1980 | Brown | 156/580.2 |
| 4,426,244 | 1/1984 | Wang | 264/23 |
| 4,518,551 | 5/1985 | Lin | 425/806 |
| 4,567,797 | 2/1986 | Folk | 83/701 |
| 4,596,171 | 6/1986 | Gerber | 83/701 |
| 4,654,969 | 4/1987 | Schwartzott | 83/169 |
| 4,670,210 | 6/1987 | Boggs | 425/806 |
| 4,733,997 | 3/1988 | Ford et al. | 264/138 |
| 4,922,774 | 5/1990 | Oldeman | 83/701 |
| 5,015,223 | 5/1991 | Boeckmann | 156/581 |

FOREIGN PATENT DOCUMENTS

| | | |
|---|---|---|
| 1932975 | 1/1971 | Fed. Rep. of Germany . |
| 2107331 | 8/1972 | Fed. Rep. of Germany . |
| 3529686 | 2/1987 | Fed. Rep. of Germany . |

*Primary Examiner*—Jay H. Woo
*Assistant Examiner*—Duane S. Smith
*Attorney, Agent, or Firm*—Collard & Roe

[57] ABSTRACT

The invention relates to an apparatus for cutting a workpiece made of a polymer. The apparatus combines a cutting tool operable to perform a feed movement along a desired line of cut relative to a portion of the workpiece to be cut, the cutting tool includes a cutter blade subjected to ultrasonic vibration as it cuts the portion of the workpiece, with a thermal control arranged to maintain the portion of the workpiece at a pre-selected temperature.

3 Claims, 1 Drawing Sheet

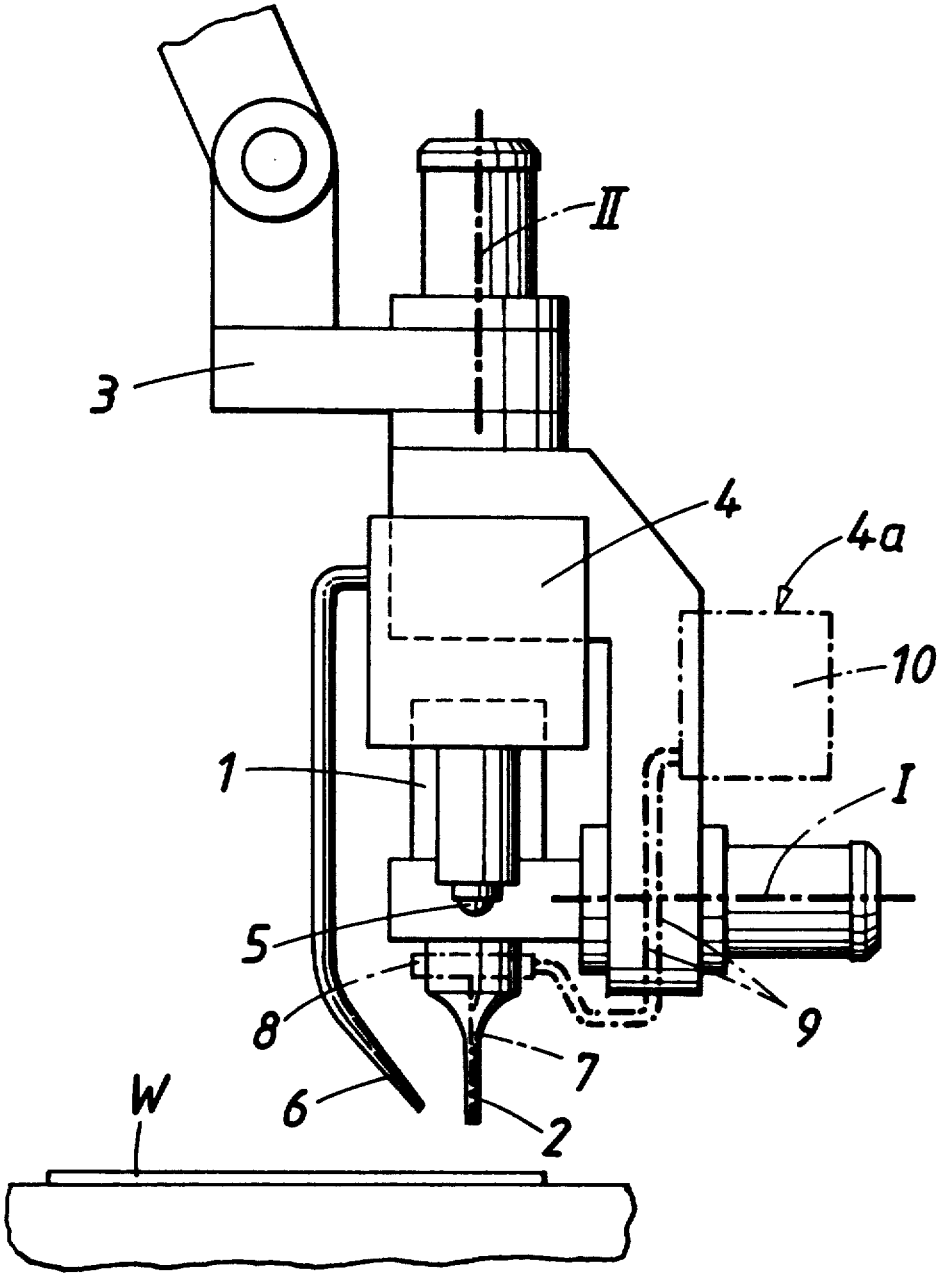
II
3
4
4a
10
1
I
5
8
9
7
W
6
2

APPARATUS FOR ULTRASONICALLY CUTTING WORKPIECES MADE OF POLYMERS

BACKGROUND OF THE INVENTION

1. Field of the Invention

This invention relates to an apparatus for cutting workpieces made of polymers, particularly of synthetic thermoplastic polymers or fiber-reinforced polymers, wherein a cutting tool is caused to perform a feed movement along a desired line of cut.

2. Description of the Prior Art

Considerable difficulties usually arise in the cutting of numerous polymers, particularly synthetic thermoplastic polymers and fiber-reinforced polymers, to a desired shape because such polymers when cured have a high strength, which may be increased further by reinforcing fibers. For this reason such cutting operations had mainly to be performed in the past by contour milling although this is a rather expensive operation, which involves a considerable loss of chip material.

SUMMARY OF THE INVENTION

It is an object of the invention to eliminate said disadvantages and to provide an economical apparatus of cutting plastics.

The object set forth hereinbefore is accompolished in accordance with the invention in that the workpieces are cut by means of a cutter blade, which is vibrated at an ultrasonic frequency, and the temperature of the workpiece at least in a portion which is about to be cut is maintained at a temperature that is selected in dependence on the thermal characteristics of the polymer of which the workpiece has been made. An ultrasonic cutter is inherently suitable for a neat cutting of conventional materials or for a severing of fibrous structures but without an adoption of additional measures such a cutter could not be used to cut cured polymers as desired. But if the cutter is heated or cooled to maintain it at a temperature which is selected in dependence on the thermal characteristics of the polymer the polymer can be caused to assume a state in which it can satisfactorily be cut by the ultrasonic cutter. For instance, a thermoplastic material can be softened by heating, and a thermoset plastic can be cooled to inhibit a thermal curing. For this reason the combination of the ultrasonic cutting and of the temperature control of the plastic will permit an economical and accurate cutting of workpieces made of any desired polymers or of fiber-reinforced polymers with a high efficiency and a low loss of material.

The temperature of the workpiece in a portion which is about to be cut may be controlled by a control of the temperature of the cutter or by a separate heat source. Alternatively, the cutter temperature is preselected and properly automatically controlled or the workpiece is directly heated by a separate heat source. Suitable automatic control means may be used to compare the actual temperature of the workpiece with a preselected set point and to control the cutter temperature or the power of the heat source as required so that the polymer which is about to be cut by the ultrasonic cutter will have the optimum temperature for being cut.

To permit a combination of an ultrasonic cutting and the desired temperature control of the workpiece, the invention provides also an ultrasonic cutting unit which comprises an ultrasonic horn, such as a Sonotrode®, provided with a cutter blade, as well as heating or cooling means. Such heating or cooling means can be used to heat the workpiece if it is made of thermoplastic materials, so that they will be sufficiently soft for being cut by the ultrasonic cutter, or to prevent an undesired heating of a workpiece that is made of a thermoset polymer so that even thermoset polymers can easily be cut by the ultrasonic cutter.

The ultrasonic horn may contain flow passages, which are connected to the heating or cooling means for a circulation of a heat transfer fluid. In that case the temperature of the cutter can suitably be controlled in order to heat or cool the workpiece because the ultrasonic horn can be supplied with a heating or cooling fluid at such a rate that the ultrasonic horn and the cutter will be maintained at a predetermined temperature if an allowance is made for the heat inherently generated by the cutting operation.

For a control of the temperature of the workpiece independently of the cutter, the ultrasonic horn may be preceded in the feeding direction by a heat radiator, such as an infrared lamp, or by a fan for blowing hot or cool air onto the workpiece. The heat radiated from the heat radiator will be focussed on the portion being cut, and the fan will be arranged to direct jets of hot or cool air onto the portion being cut. As a result, the temperature of that portion of the workpiece which is about to be cut may directly be controlled in a confined area so that thermoplastic materials can be heated as required and thermoset materials can be cooled without a need for a high expenditure of equipment. In case of need, the heating or cooling means may be provided above and below the workpiece and may be moved in synchronism with the cutter so that the workpiece portion being cut will be thermally controlled on both sides as the cutter is advanced.

BRIEF DESCRIPTION OF THE DRAWING

The drawing is a schematic side elevation showing an apparatus in accordance with the invention.

DETAILED DESCRIPTION OF THE PREFERRED EMBODIMENT

An illustrated embodiment of the invention will now be described more in detail with reference to the drawing.

For an economical automatic cutting of workpieces W made, e.g., of fiber-reinforced polymer material by means of a cutter blade, an ultrasonic cutting unit 1 is provided, which comprises an ultrasonic horn 2, such as a Sonotrode®, which carries a cutter blade. The cutting unit 1 is mounted for rotation about two axes I, II, which are normal to each other, in a robot arm 3, which is controlled to move about a plurality of axes, so that any desired feed movements can be imparted to the cutting unit 1, including feed movements for a three-dimensional cut. The robot arm 3 also carries thermal control means 4 for effecting a local temperature control of the workpiece in that portion of the workpiece which is about to be cut. Such thermal control means 4 may comprise, e.g., an infrared lamp 5 as a heat source and cooling means consisting of an airblowing tube 6. The rays from the infrared lamp 5 and the air jet from the blasting tube 6 are directed onto that portion of the workpiece W which is about to be cut.

As is indicated in phantom the thermal control means 4a may comprise flow passages 7, which are provided in the ultrasonic horn 2 and connected by suitable ports 8 to supply and return lines 9 for conducting a heat transfer fluid from and to a heater or cooler 10. That heater or cooler 10 can be operated to heat or cool the heat transfer fluid, which preferably consists of air, so that said fluid will flow at a desired temperature and a desired rate into the ultrasonic horn 2 to control the temperature of the horn and, as a result, the temperature of the workpiece portion which is about to be cut.

By means of the thermal control means 4 that workpiece portion which is about to be cut can be maintained at a desired temperature so that the polymer in dependence of its thermal characteristics can be caused to assume a suitable state for the subsequent ultrasonic cutting and an optimum cutting operation is thus ensured, in which the ultrasonic cutter satisfactorily severs the material that is at a suitable temperature for being cut and also exactly cuts through the reinforcing fibers.

I claim:

1. An apparatus for cutting a workpiece made of a polymer, comprising the combination of (a) an ultrasonic cutting unit operable to perform a feed movement along a desired line of cut relative to a portion of the workpiece to be cut, the cutting unit comprising (1) an ultrasonic horn provided with a cutter blade subjected to ultrasonic vibration by the ultrasonic horn as said blade cuts the portion of the workpiece, the ultrasonic horn defining flow passages for a heat transfer fluid, and (b) a thermal control means arranged to maintain said portion of the workpiece at a pre-selected temperature, the thermal control means comprising (1) a source of heat transfer fluid and (2) means for controlling the temperature of the heat transfer fluid to maintain the pre-selected temperature, (3) the flow passages being arranged to conduct the heat transfer fluid to the portion of the workpiece to be cut.

2. An apparatus for cutting a workpiece made of a polymer, comprising the combination of (a) a cutting tool operable to perform a feed movement along a desired line of cut relative to a portion of the workpiece to be cut, the cutting tool comprising (1) a cutter blade and (2) means for subjecting the cutter blade to ultrasonic vibration as it cuts the portion of the workpiece, and (b) thermal control means arranged to maintain said portion of the workpiece at a pre-selected temperature, the thermal control means comprising (1) an infrared lamp preceding the cutter blade in the direction of the feed movement for irradiating the portion of the workpiece to be cut.

3. An apparatus for cutting a workpiece made of a polymer, comprising the combination of (a) a cutting tool operable to perform a feed movement along a desired line of cut relative to a portion of the workpiece to be cut, the cutting tool comprising (1) a cutter blade and (2) means for subjecting the cutter blade to ultrasonic vibration as it cuts the portion of the workpiece, and (b) thermal control means arranged to maintain said portion of the workpiece at a pre-selected temperature, the thermal control means comprising (1) means for directing a jet of temperature-controlled air on the portion of the workpiece to be cut, said means preceding the cutter blade in the direction of the feed movement.

* * * * *